US009626854B2

(12) United States Patent
Yang

(10) Patent No.: US 9,626,854 B2
(45) Date of Patent: Apr. 18, 2017

(54) LIFEGUARD ALARM SYSTEM FOR DETECTING A STATE OF A SWIMMER

(71) Applicant: Bing-Syun Yang, Changhua County (TW)

(72) Inventor: Bing-Syun Yang, Changhua County (TW)

( * ) Notice: Subject to any disclaimer, the term of this patent is extended or adjusted under 35 U.S.C. 154(b) by 0 days.

(21) Appl. No.: 14/067,927

(22) Filed: Oct. 30, 2013

(65) Prior Publication Data

US 2015/0116116 A1 Apr. 30, 2015

(30) Foreign Application Priority Data

Nov. 24, 2012 (TW) ..... 101144097 A

(51) Int. Cl.
*G08B 21/08* (2006.01)

(52) U.S. Cl.
CPC ..... *G08B 21/088* (2013.01)

(58) Field of Classification Search
CPC ..... G08B 21/08
USPC ..... 340/573.6
See application file for complete search history.

(56) References Cited

U.S. PATENT DOCUMENTS

| | | | | |
|---|---|---|---|---|
| 8,022,830 | B1 | 9/2011 | Yang | |
| 2008/0264141 | A1* | 10/2008 | Kenmochi | 73/1.08 |
| 2011/0187538 | A1* | 8/2011 | Hawkins | 340/573.6 |
| 2012/0158296 | A1* | 6/2012 | Waters et al. | 701/509 |

* cited by examiner

*Primary Examiner* — Omer S Khan

(57) ABSTRACT

A lifeguard alarm system for swimmers, capable of detecting whether a swimmer is moving forward or drowning. The system includes a detecting device, an accelerometer disposed on the detecting device and a computing unit; the accelerometer configured to output respective acceleration values along X, Y, and Z axes of the detecting device and of gravity, the computing unit configured to calculate a sum of squares of the X, Y and Z acceleration values of the accelerometer as a first value and square of an acceleration of gravity as a second value and to compare the first value with the second value. A relationship between the first value and the second value can be used to control the warming unit.

2 Claims, 2 Drawing Sheets

LIFEGUARD ALARM SYSTEM FOR DETECTING A STATE OF A SWIMMER

BACKGROUND OF THE INVENTION

1. Field of the Invention

The present invention relates to a lifeguard alarm system for detecting a state of a swimmer, and more particularly to a lifeguard alarm system having a sensing device that can obtain the state of the swimmer.

2. Description of the Related Art

Currently, when a drowning event occurs while swimming, if the victim can issue a distress signal to the surrounding environment the chances of survival are increased. There exist systems to detect whether there is a forward speed to determine the existence of forward movement of an object, such as inertial navigation systems used in aviation, which may employ gyroscopes, accelerometers, magnetometers and integral calculus to determine aircraft position, direction and attitude information, as well as other flight and navigational information, for pilots. Typically, an inertial reference system includes: (1) the use of a stable characteristic rotational axis gyro, which senses orientation and attitude changes; (2) a magnetic compass for sensing the current aircraft heading; and (3) an accelerometer. When the airplane is stationary, the current longitude and latitude data of the aircraft are entered, and as the plane moves as measured using the accelerometer, which has a three-dimensional acceleration axes of detection, computer calculates translation of the course, speed and displacement. But inertial navigation errors accumulate over time, and therefore are not suitable for long-term use, such as with a swimmer to detect drowning.

Therefore, it is desirable to provide a lifeguard alarm system for detecting a state of a swimmer to mitigate and/or obviate the aforementioned problems.

SUMMARY OF THE INVENTION

An objective of the present invention is to provide a lifeguard alarm system for detecting a state of a swimmer, which is designed for detecting forward movement from the swimmer to determine whether the swimmer is drowning.

In order to achieve the above-mentioned objective, a lifeguard alarm system for detecting a state of a swimmer comprises: a detecting device, an accelerometer disposed on the detecting device and a computing unit; the accelerometer configured to output respective acceleration values along X, Y, and Z axes of the detecting device and of gravity, the computing unit configured to calculate a sum of squares of the X, Y and Z acceleration values of the accelerometer as a first value and square of an acceleration of gravity as a second value and to compare the first value with the second value. Furthermore, the detecting device further has a warming unit for generating warming light, sound or electronic signal.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
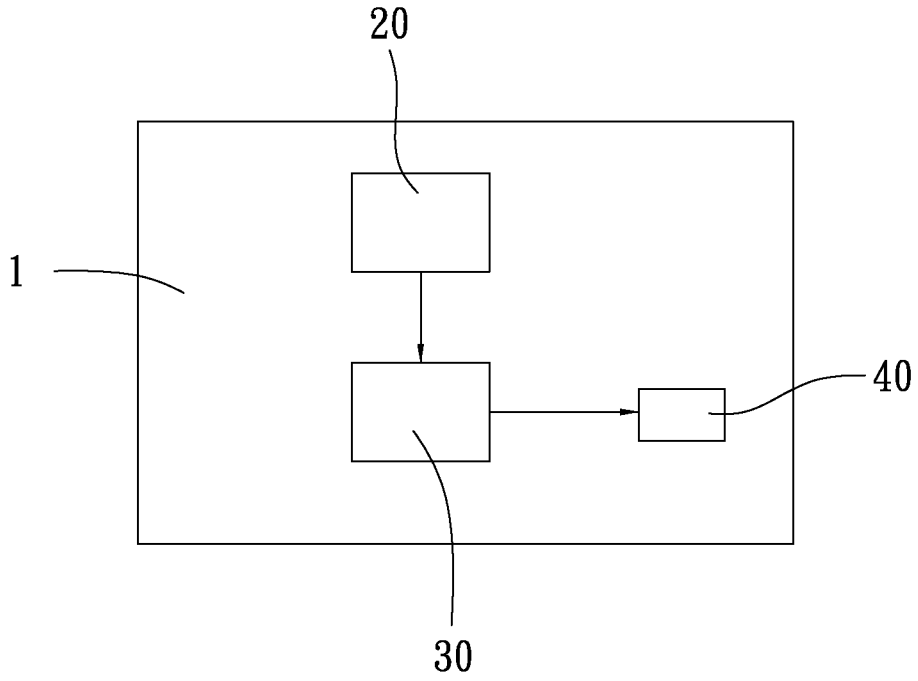
FIG. 1 is a functional block drawing of an embodiment of the present invention.
Figure 2:
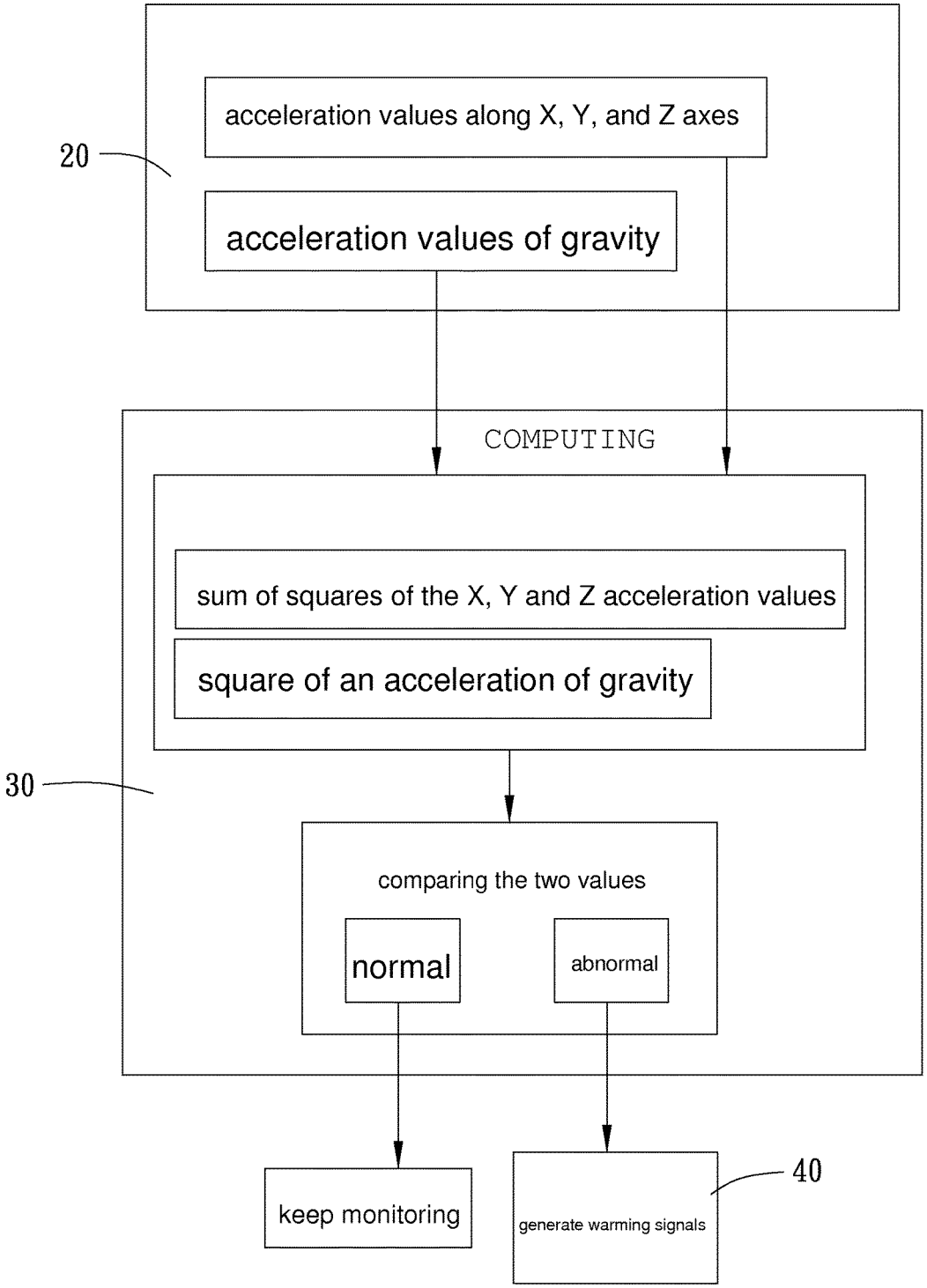
FIG. 2 is flow chart of the embodiment of the present invention.

Please refer to FIG. 1 and FIG. 2. A lifeguard alarm system for detecting a state of a swimmer comprises: a detecting device 1 which can be wear on the swimmer, an accelerometer 20 disposed on the detecting device 1, a computing unit 30 and a warming unit 40. The accelerometer 20 is configured to output respective acceleration values along X, Y, and Z axes of the detecting device 1 and of gravity. The computing unit 30 is configured to calculate a sum of squares of the X, Y and Z acceleration values of the accelerometer 20 as a first value and an acceleration of gravity as a second value and to compare the first value with the second value.

The warming unit 40 is capable of generating warming light, sound or electronic signal.

When the swimmer is swimming with the alarm system, a relationship between the first value and the second value is used for determining whether the swimmer is normal or drowning.

Alternatively, the computing unit further calculates a square root of the first value or the first value is a value smaller than the second value, and the first value is smaller than a predetermined value lower than the second value.

Further explanation of the present invention is provided as following, since the acceleration is a vector not affected by rotation, a square root value of the sum of squares the output values of the X, Y and Z three axles of the accelerometer 20 is a total acceleration of the accelerometer. If an acting force is applied on the horizontal direction, a first value H is a smaller values; and if the acting force is applied on the vertical direction, a first value V is larger than the first value H. For example, the gravity is 10 $m/s^2$, when an acting force 0.1 $m/s^2$ is applied on the vertical direction, the first value is 102.01; but if the acting force 1 $m/s^2$ is applied on the horizontal direction, the first value is 101. It is almost impossible for a swimmer to achieve a swimming speed as 1 $m/s^2$ for a long period of time but it is very easy to achieve a swimming speed as 0.1 $m/s^2$. When the swimmer swims with the alarm system, if the first value maintains larger than a predetermined value or smaller than the second value for a certain predetermined period of time, it indicates the swimmer is not moving forward even drowning. In normal condition, swimmer moves mainly forward and up and down for breathing, when the first value is larger than the predetermined value or smaller than the second value for a longer time period or more often frequency, the drowning possible of the swimmer is higher. Moreover, the alarm system is designed as water-resistant and portable dimensions. In addition, the accelerometer might generate an offset value, therefore, the predetermined value is preset as smaller than the second value. For example, if the first value is larger than 118% of the second value or smaller than 95% of the second value, the warming will generate warming signals.

Although the present invention has been explained in relation to its preferred embodiment, it is to be understood that many other possible modifications and variations can be made without departing from the spirit and scope of the invention as hereinafter claimed.

What is claimed is:

1. A lifeguard alarm system for swimmers, capable of detecting whether a swimmer is moving forward or drowning, the system comprising:

a detecting device, an accelerometer disposed on the detecting device and a computing unit;

the accelerometer configured to output respective acceleration values along X, Y, and Z axes of the detecting device and of gravity, the computing unit configured to calculate a sum of squares of the X, Y and Z acceleration values of the accelerometer as a first value and square of an acceleration of gravity as a second value and to compare the first value with the second value;

wherein the detecting device further has a warning unit for generating a warning light, sound or electronic signal;

wherein the first value changes in response to a movement of the swimmer when the swimmer moves;

wherein when the first value is 118% more than the second value or is 95% less than the second value for a period of phenomenon, the swimmer is drowning or struggles and moves upward and downward in water, and the warning unit generates the warning light, the sound or the electronic signal.

2. The lifeguard alarm system for swimmers as claimed in claim 1, wherein the computing unit further calculates a square root of the first value.

* * * * *